US011125011B2

(12) United States Patent
Jang

(10) Patent No.: US 11,125,011 B2
(45) Date of Patent: Sep. 21, 2021

(54) CORDLESS BLIND APPARATUS AND METHOD OF ADJUSTING A CORDLESS BLIND APPARATUS

(71) Applicant: WINTEC KOREA INC., Gwangju-si (KR)

(72) Inventor: Seong-ryong Jang, Seoul (KR)

(73) Assignee: WINTEC KOREA INC., Gwangju-si (KR)

( * ) Notice: Subject to any disclaimer, the term of this patent is extended or adjusted under 35 U.S.C. 154(b) by 72 days.

(21) Appl. No.: 16/622,484

(22) PCT Filed: Aug. 31, 2017

(86) PCT No.: PCT/KR2017/009578
§ 371 (c)(1),
(2) Date: Dec. 13, 2019

(87) PCT Pub. No.: WO2018/235993
PCT Pub. Date: Dec. 27, 2018

(65) Prior Publication Data

US 2020/0141183 A1 May 7, 2020

(30) Foreign Application Priority Data

Jun. 19, 2017 (KR) ..... 10-2017-0077589

(51) Int. Cl.
*E06B 9/42* (2006.01)
*E06B 9/60* (2006.01)
(Continued)

(52) U.S. Cl.
CPC ..... *E06B 9/42* (2013.01); *E06B 9/60* (2013.01); *E06B 9/322* (2013.01); *E06B 9/58* (2013.01);
(Continued)

(58) Field of Classification Search
CPC ... E06B 9/42; E06B 9/60; E06B 9/322; E06B 2009/3222; E06B 9/58; E06B 9/90
See application file for complete search history.

(56) References Cited

U.S. PATENT DOCUMENTS

2007/0023151 A1 2/2007 Judkins
2011/0005694 A1* 1/2011 Ng ..... E06B 9/60 160/311
(Continued)

FOREIGN PATENT DOCUMENTS

JP 2004-100227 A 4/2004
JP 2007-023611 A 2/2007
(Continued)

*Primary Examiner* — Beth A Stephan
(74) *Attorney, Agent, or Firm* — Novick, Kim & Lee, PLLC; Jae Youn Kim

(57) ABSTRACT

The present invention provides a cordless blind apparatus and a method of adjusting the balance of a cordless blind apparatus. The cordless blind apparatus includes a roller, a screen wound or unwound on the roller, and a torsion spring contracting or stretching by rotating with the roller, in which an increasing ratio of torque applied to the roller by the screen and an increasing ratio of torque applied to the roller by the torsion spring are matched to each other through the correlation equation satisfied by parameters as the wire diameter 'd' of the torsion spring, the Young's modulus 'E' of the torsion spring, the diameter 'D' of the torsion spring, the winding number 'N' of the torsion spring, the density 'ρ' of the screen, the thickness 't' of the screen, the width 'S' of the screen, the radius 'R' of the roller, and gravitational acceleration 'g'.

9 Claims, 7 Drawing Sheets

(51) Int. Cl.
*E06B 9/322* (2006.01)
*E06B 9/58* (2006.01)
*E06B 9/90* (2006.01)

(52) U.S. Cl.
CPC ..... *E06B 9/90* (2013.01); *E06B 2009/3222* (2013.01)

(56) References Cited

U.S. PATENT DOCUMENTS

| | | | | |
|---|---|---|---|---|
| 2011/0024064 | A1* | 2/2011 | Ng | E06B 9/42 160/317 |
| 2015/0047795 | A1* | 2/2015 | Bohlen | E06B 9/42 160/316 |
| 2016/0083999 | A1* | 3/2016 | Chen | E06B 9/42 160/315 |
| 2016/0290043 | A1* | 10/2016 | McPherson, Jr. | E06B 9/78 |
| 2017/0067289 | A1 | 3/2017 | Campagna | |

FOREIGN PATENT DOCUMENTS

| | | | |
|---|---|---|---|
| JP | 2008-106563 | A | 5/2008 |
| JP | 2016-108920 | A | 6/2016 |
| KR | 10-2009-0085431 | A | 8/2009 |
| KR | 20-0480955 | Y1 | 7/2016 |

* cited by examiner

[Fig. 1]
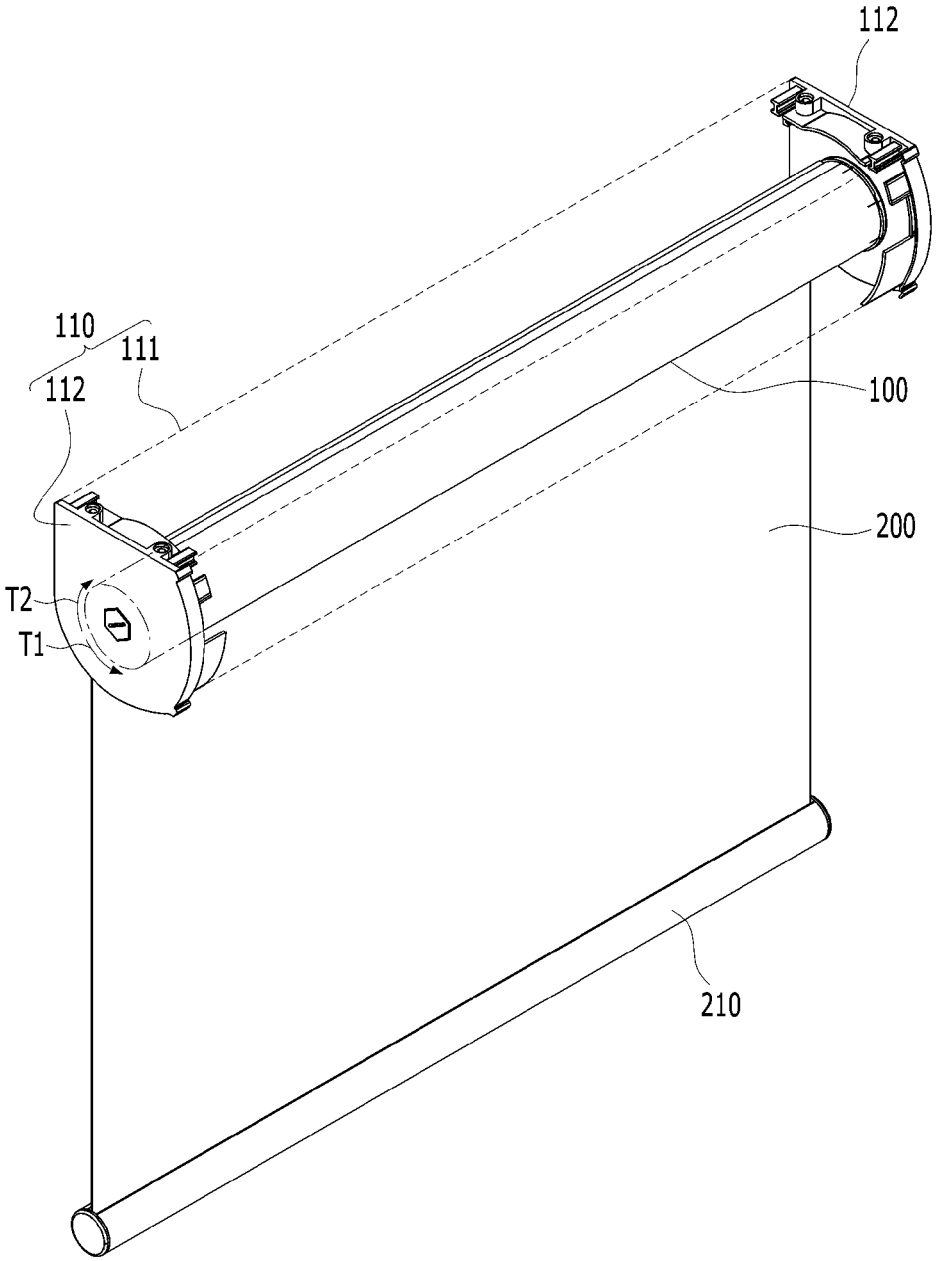

[Fig. 2]
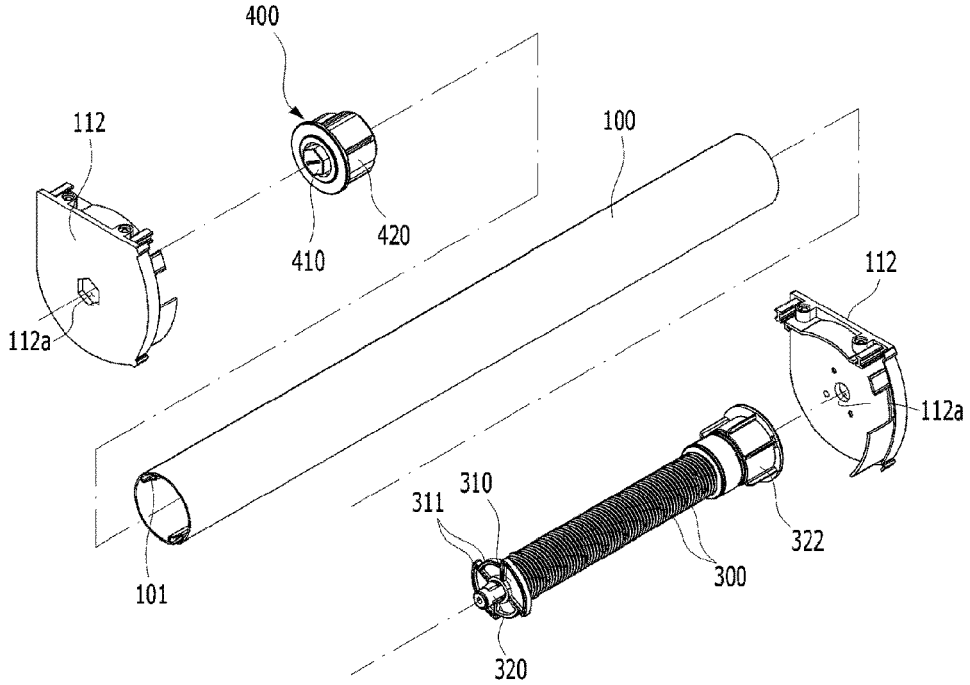
[Fig. 3]
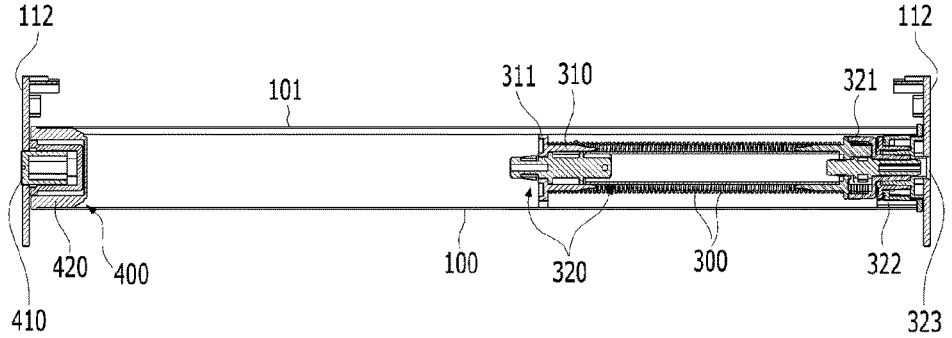
[Fig. 4]
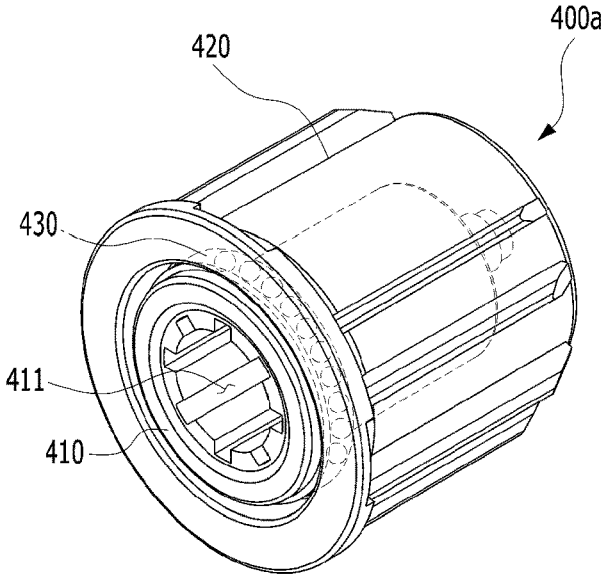

[Fig. 5]
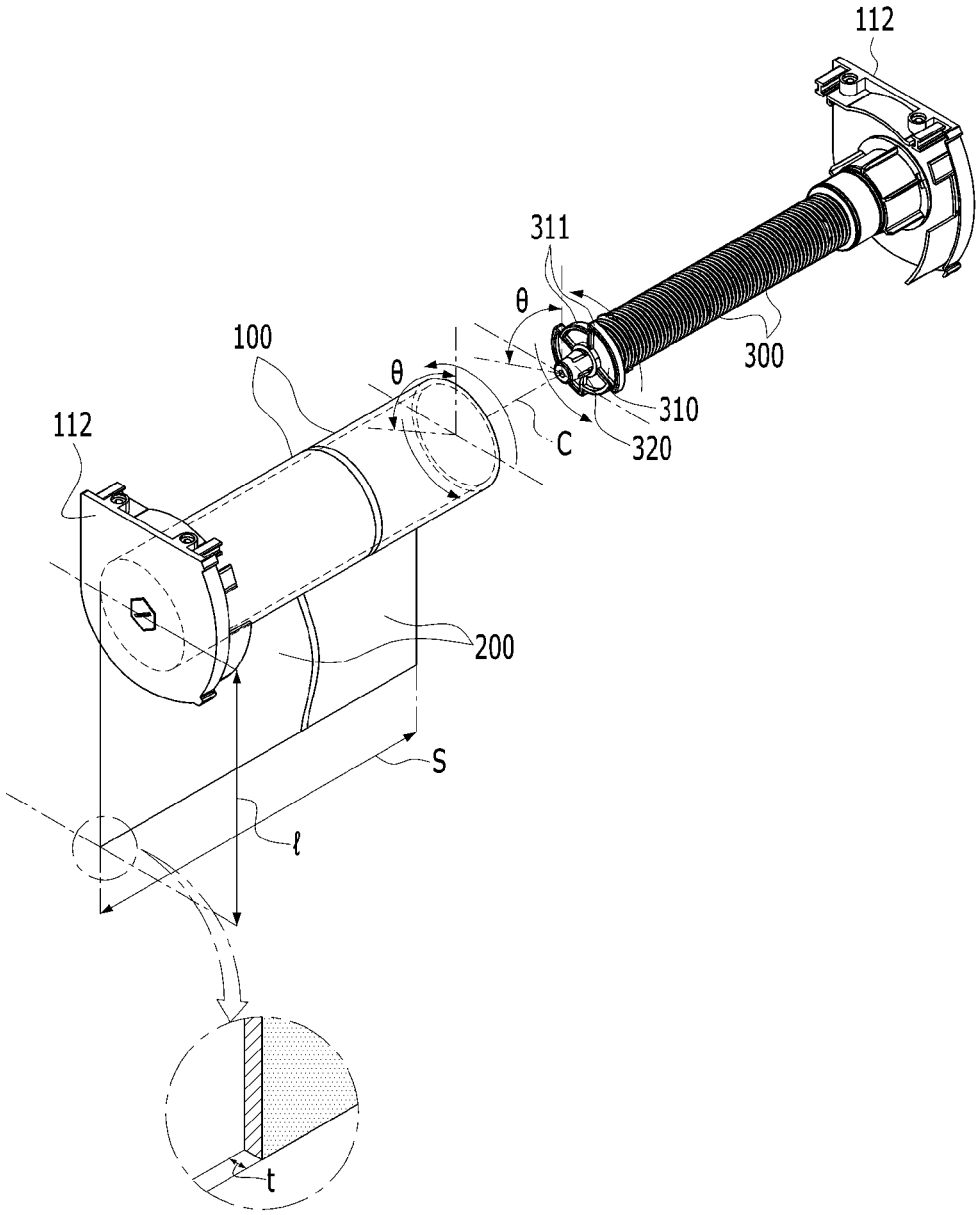

[Fig. 6]
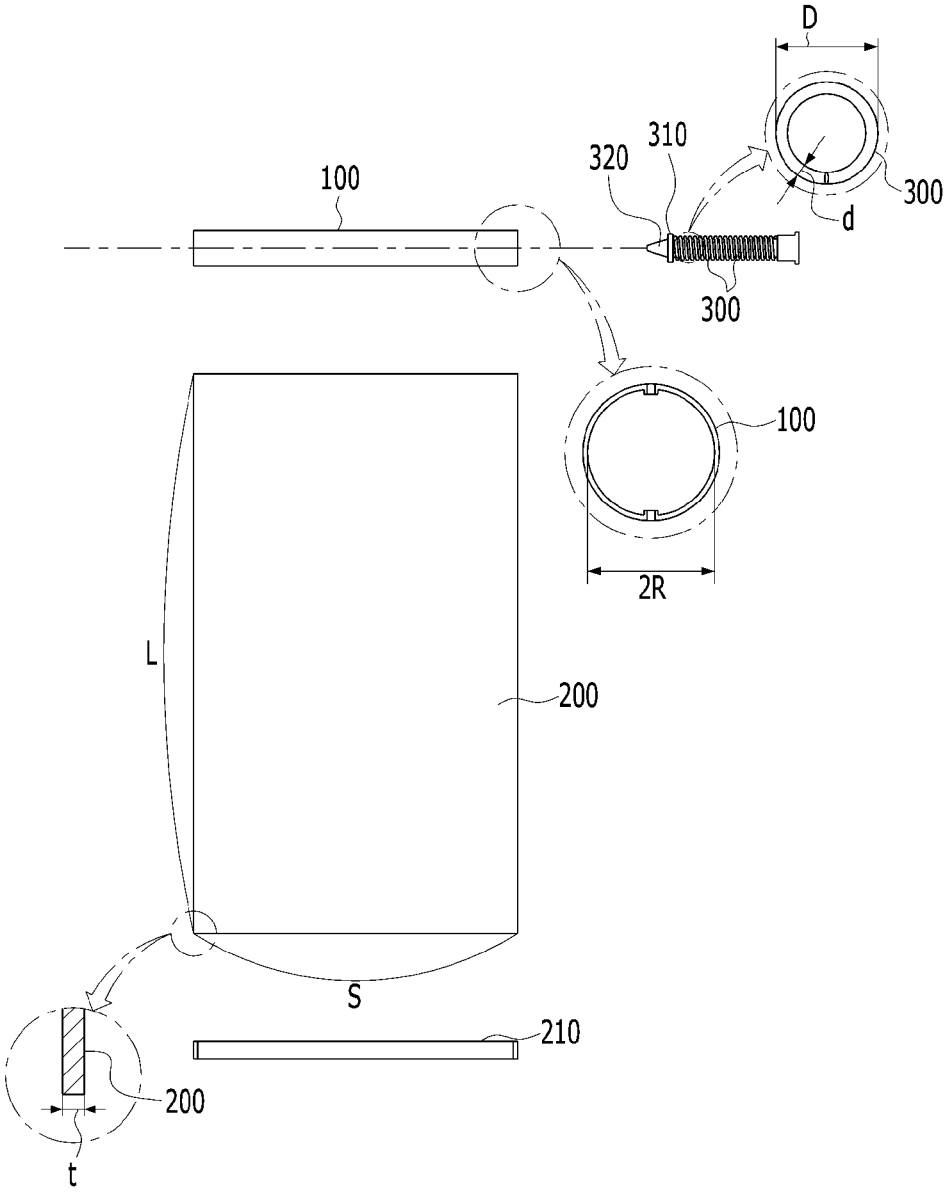

[Fig. 7]
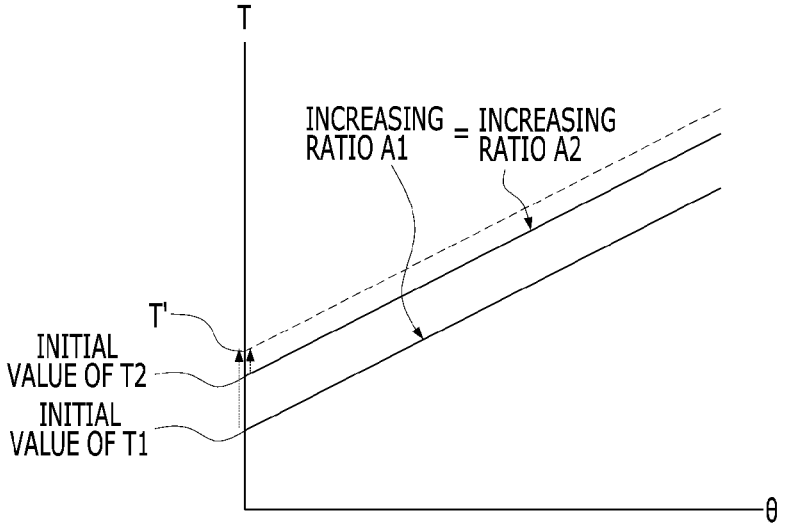
(a)
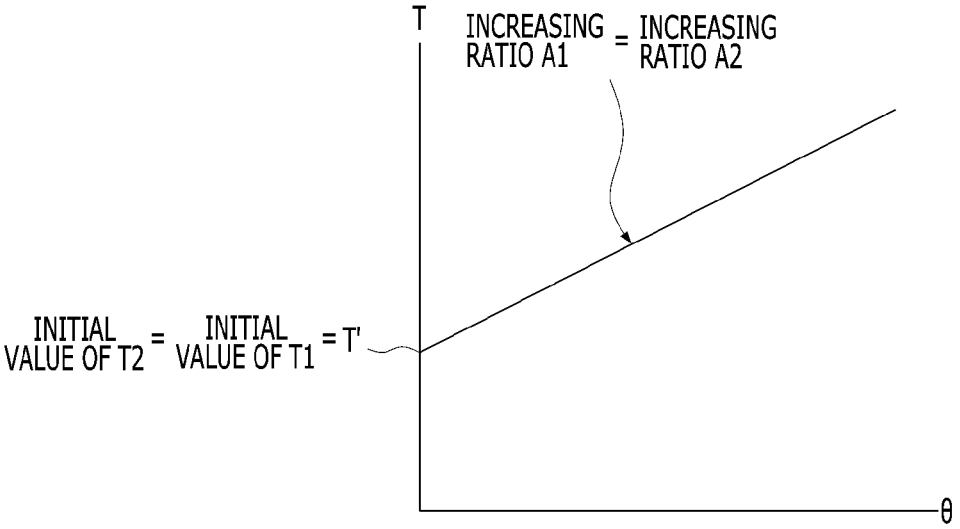
(b)

[Fig. 8]
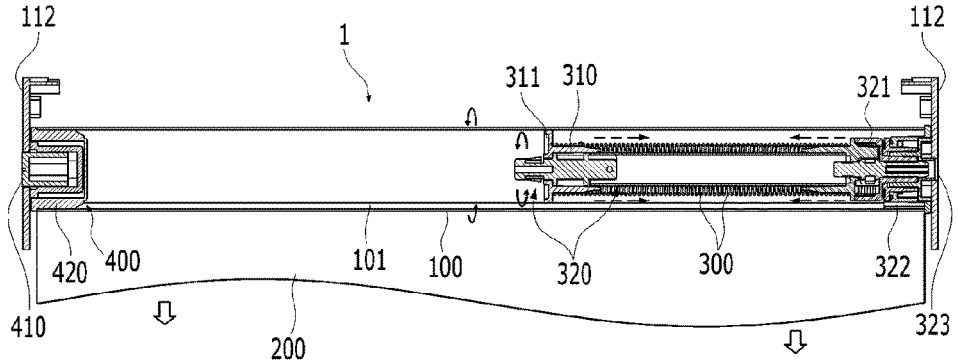
(a)
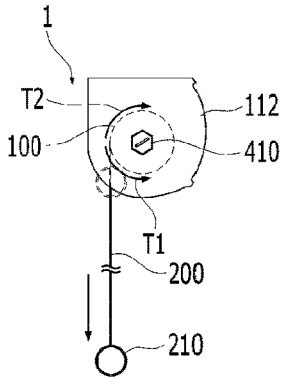
[Fig. 9]
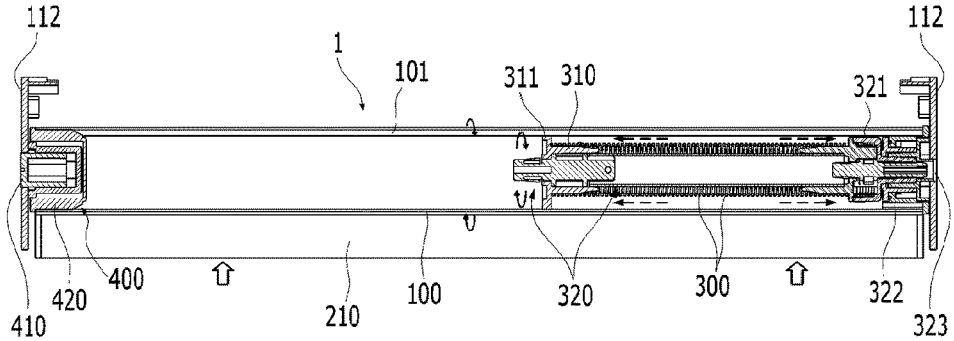
(a)
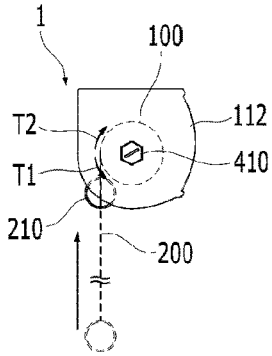

[Fig. 10]
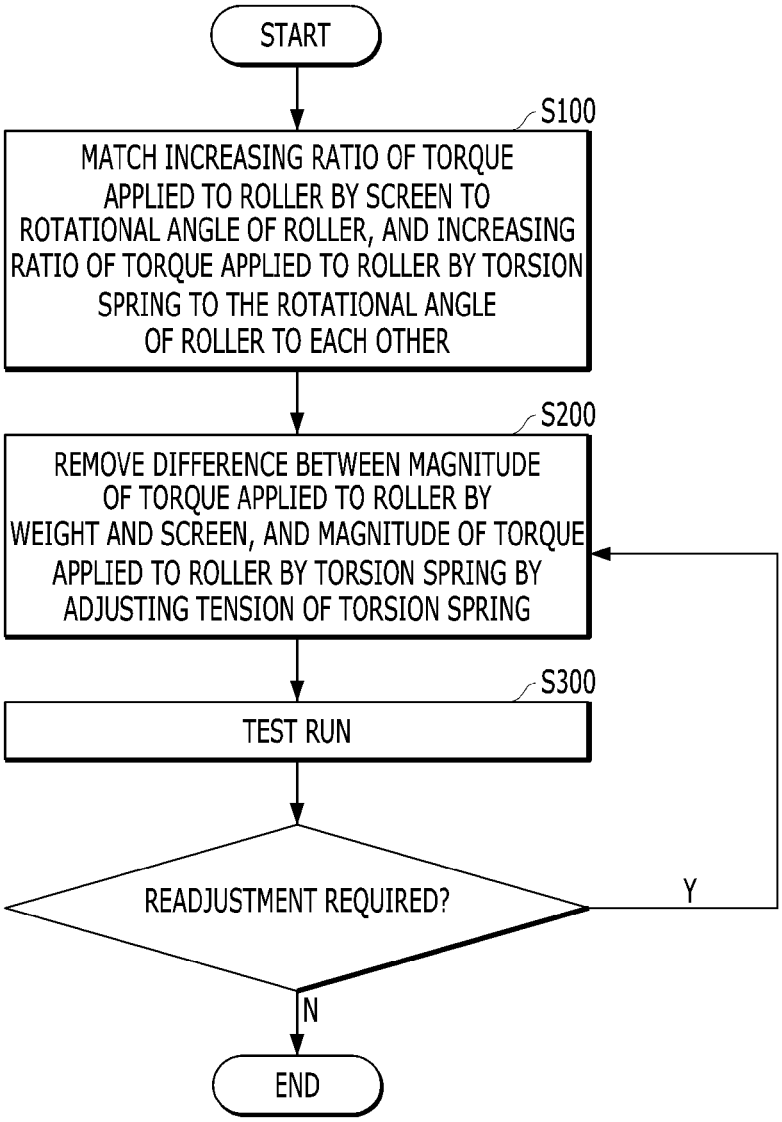

CORDLESS BLIND APPARATUS AND METHOD OF ADJUSTING A CORDLESS BLIND APPARATUS

TECHNICAL FIELD

The present invention relates to a cordless blind apparatus that can be conveniently operated without a cord and a method of adjusting the cordless blind apparatus. More particularly, the present invention relates to a cordless blind apparatus of which the balance can be precisely adjusted and a method of precisely adjusting the balance of a cordless blind apparatus.

BACKGROUND ART

A blind apparatus is installed over a window and has a structure that can cover/uncover the window. It is possible to obtain a desired effect by controlling the amount of incident light by adjusting the degree of the window blocked by a blind apparatus. For example, it is possible to produce a soft glow effect using a blind apparatus and it is also possible to block unnecessary gaze from the outside.

A blind apparatus may include a screen that is rolled and unrolled. It is possible to open a portion or the entire of a window and adjust the amount of incident light by adjusting the length of the unrolled screen. In such a blind apparatus, the length of the unrolled screen can be controlled by using a cord that rotates the rolled part of the screen.

However, when the rolled screen is rotated by pulling the cord, force may be concentrated on the cord's connecting side. That is, when the cord is pulled to operate the apparatus, the external force is concentrated on the side connected with the cord, so the apparatus may be structurally unbalanced or the joint between the rolled part of the screen and the cord may be easily broken.

Also, the long cord is an obstacle that people, particularly, careless children easily trip on, so there is a high possibility of a safety accident. Further, it is difficult to uniformly rotate the entire rolled part of the screen with the cord, so the rotary structure is unnecessarily complicated to compensate the defect. Therefore, it is required to solve this problem.

CITATION LIST

Patent Literature (Patent Literature 1) Korean Utility Model No. 20-0480955 (2016 Jul. 29)

DISCLOSURE

Technical Problem

The present invention has been made in an effort to solve the problem and an object of the present invention is to provide a cordless blind apparatus that can be conveniently operated without a cord and a method of adjusting a cordless blind apparatus, particularly, to provide a cordless blind apparatus of which the balance can be precisely adjusted and a method of precisely adjusting balance of a cordless blind apparatus.

Technical Solution

A cordless blind apparatus of the present invention includes a roller coupled to a shaft to rotate, a screen wound or unwound on the roller, and a torsion spring contracting or stretching by rotating with the roller, in which an increasing ratio A1 of torque applied to the roller by the screen to a rotational angle of the roller and an increasing ratio A2 of torque applied to the roller by the torsion spring to the rotational angle of the roller are matched to each other through the following correlation equation, $$A1 = A2,\ A1 = \rho \times t \times S \times R^2 \times g, \quad A2 = \frac{(d^4 \times E)}{(64 \times D \times N)} \qquad \text{[Correlation equation]}$$

using, the wire diameter 'd' of the torsion spring, the Young's modulus 'E' of the torsion spring, the diameter 'D' of the torsion spring, the winding number 'N' of the torsion spring, the density 'ρ' of the screen, the thickness 't' of the screen, the width 'S' of the screen, the radius 'R' of the roller, and gravitational acceleration 'g'.

The cordless blind apparatus may further include a weight connected to the lower end of the screen and offsetting the difference between the magnitude of the torque applied to the roller by the torsion spring and the magnitude of the torque applied to the roller by the screen.

When the screen has been fully rolled up, the initial value of the torque applied to the roller by the torsion spring may be the same as the initial value of torque applied to the roller by the weight and the screen.

The torsion spring may share a rotational center with the roller.

The torsion spring may be inserted on the rotational center of the roller in parallel in the roll.

An end of the torsion spring may be connected to the roller and the other end may be fixed to a shaft passing through the rotational center of the roller.

The cordless blind apparatus may further include a bearing disposed between the roller and the shaft coupled to the roller.

A method of adjusting a cordless blind apparatus that includes a roller coupled to a shaft to rotate, a screen wound or unwound on the roller, a torsion spring contracting or stretching by rotating with the roller, and a weight connected to the lower end of the screen includes: a first step of matching an increasing ratio of torque applied to the roller by the screen to a rotational angle of the roller and an increasing ratio of torque applied to the roller by the torsion spring to the rotational angle of the roller to each other; and a second step of removing the difference between the magnitude of torque applied to the roller by the weight and the screen and the magnitude of the torque applied to the roller by the torsion spring by adjusting tension of the torsion spring.

The first step may match an increasing ratio A1 of torque applied to the roller by the screen to a rotational angle of the roller and an increasing ratio A2 of torque applied to the roller by the torsion spring to the rotational angle of the roller to each other through the following correlation equation, $$A1 = A2,\ A1 = \rho \times t \times S \times R^2 \times g, \quad A2 = \frac{(d^4 \times E)}{(64 \times D \times N)} \qquad \text{[Correlation equation]}$$

using, the wire diameter 'd' of the torsion spring, the Young's modulus 'E' of the torsion spring, the diameter 'D' of the torsion spring, the winding number 'N' of the torsion spring, the density 'ρ' of the screen, the thickness 't' of the screen, the width 'S' of the screen, the radius 'R' of the roller, and gravitational acceleration 'g'.

The second step may, when the screen has been fully rolled up, match the initial value of the torque applied to the roller by the torsion spring to the initial value of torque applied to the roller by the weight and the screen.

Advantageous Effects

According to the present invention, it is possible to achieve a cordless blind apparatus that is operated by a very simple structure without a cord. It is also possible to easily operate a screen and stably maintain the length of the screen even without an operating member such as a cord. In particular, according to the present invention, it is possible to more conveniently and accurately operate the cordless blind apparatus, since it is possible to very precisely adjust and maintain balance of a cordless blind apparatus including a screen. Further, according to the preset invention, it is possible to very precisely adjust the balance of a cordless blind apparatus including a screen, even if parameters such as the material of the screen and the diameter of the roll are changed, so it is possible to achieve a cordless blind apparatus that is very precisely and accurately operated in various ways.

DESCRIPTION OF DRAWINGS

FIG. 1 is a perspective view showing a cordless blind apparatus according to an embodiment of the present invention.

FIG. 2 is an exploded perspective view of the cordless blind apparatus shown in FIG. 1.

FIG. 3 is a vertical cross-sectional view of a roller of the cordless blind apparatus shown in FIG. 1.

FIG. 4 is a view showing a modification of a coupler of the cordless blind apparatus.

FIG. 5 is a view showing the operation principle of the cordless blind apparatus shown in FIG. 1.

FIG. 6 is an exploded view showing a roller, a screen, a torsion spring, and a weight of the cordless blind apparatus shown in FIG. 1.

FIG. 7A and FIG. 7B are views showing graphs that show a method of adjusting the cordless blind apparatus.

FIGS. 8 and 9 are views showing the operation of the cordless blind apparatus shown in FIG. 1.

FIG. 10 is a flowchart illustrating the method of adjusting a cordless blind apparatus according to an embodiment of the present invention.

MODE FOR INVENTION

The advantages and features of the present invention, and methods of achieving them will be clear by referring to the exemplary embodiments that will be describe hereafter in detail with reference to the accompanying drawings. However, the present invention is not limited to the exemplary embodiments described hereafter and may be implemented in various ways, and the exemplary embodiments are provided to complete the description of the present invention and let those skilled in the art completely know the scope of the present invention and the present invention is defined by claims. Like reference numerals indicate the same components throughout the specification.

A cordless blind apparatus according to an embodiment of the present invention and a method of adjusting the cordless blind apparatus will be described hereafter in detail with reference to FIGS. 1 to 10. For simple and clear description, a cordless blind apparatus will be described first with reference to FIGS. 1 to 9 and then based on that description, a method of adjusting the cordless blind apparatus will be described with reference to FIG. 10.

First, a cordless blind apparatus according to an embodiment of the present invention is described.

FIG. 1 is a perspective view showing a cordless blind apparatus according to an embodiment of the present invention, FIG. 2 is an exploded perspective view of the cordless blind apparatus shown in FIG. 1, FIG. 3 is a vertical cross-sectional view of a roll of the cordless blind apparatus shown in FIG. 1, and FIG. 4 is a view showing a modification of a coupler of the cordless blind apparatus.

Referring to FIGS. 1 to 4, a cordless blind apparatus 1 according to an embodiment of the present invention has a simple structure without a manually operated structure such as a cord in the related art. The cordless blind apparatus 1 is semi-automatically operated using elasticity of a torsion spring 300, and particularly, keeps the balance by compensating (cancelling out) the load of a screen 200 connected to a roller 100 with the elastic force of the torsion spring 300. That is, the cordless blind apparatus 1 of the present invention has been designed to be able to finely cancel out load that depends on the length of the screen 200 with elastic force that depends on contraction and stretch of the torsion spring 300.

To this end, according to the present invention, the increasing ratios (see the slopes A1 and A2 in FIG. 7A and FIG. 7B) of forward and backward torques (see T1 and T2 in FIG. 2) that are applied to the roller 100 are matched to each other through the following correlation equation satisfied by parameters of the roller 100, the torsion spring 300, and the screen 200. That is, the increasing ratios of torque (hereafter, referred to as first-directional torque, that is, T1) that is applied to the roller 100 through the screen 200 and backward torque (hereafter, referred to as second-directional torque, that is, T2) that is applied to the roller 100 through the torsion spring 300 are finely matched to each other, whereby it is possible to very easily keep the balance. The correlation equation and the meanings of the characters are as follows.

$$A1 = A2,\ A1 = \rho \times t \times S \times R^2 \times g, \qquad \text{[Correlation equation]}$$

$$A2 = \frac{(d^4 \times E)}{(64 \times D \times N)}$$

[Characters]

d: wire diameter of torsion spring, E: Young's modulus of torsion spring, D: diameter of torsion spring, N: winding number of torsion spring, ρ: density of screen, t: thickness of screen, S: width of screen, R: radius of roller, g: gravitational acceleration.

The correlation equation is set such that the left side and right side maintain the same increasing ratios A1 and A2 to the rotating angle (hereafter, referred to as rotational angle) of the roller 100. Accordingly, when the initial conditions (the initial values of the torques) are the same, the torques applied in opposite directions to the roller 100 can be finely offset with the balance maintained in accordance with a linear proportional relationship. Further, in the cordless blind apparatus 1 of the present invention, it is possible to completely match the initial values (that is, the initial conditions) of the torques applied to the roller 100 by adjusting the tension in the screen 200 using a weight 210 connected to the screen 200 or by winding or unwinding the torsion spring 300 in the initial state (for example, when the screen has been fully rolled up). Accordingly, it is possible to not only make the blind apparatus very simple, but more finely and accurately operate the blind apparatus without a structure (for example, a friction structure) that is added in preparation for unbalance.

The cordless blind apparatus 1 according to an embodiment of the present invention includes: a roller 100 coupled to a shaft to rotate; a screen 200 that is wound or unwound on the roller 100; a torsion spring 300 that is rotated with the roller 100 to contract or stretch; and a weight 210 that is connected to the lower end of the screen 200 to remove the difference between torque applied to the roller 100 by the torsion spring 300 and torque applied to the roller 100 by the screen 200. Hereinafter, the structure of the cordless blind apparatus 1 is described first, and then the correlation equation, the torque that is applied to the roller 100, torque increasing ratios that are matched by the correlation equation, the initial values of torques, and an adjustment process are described in detail.

The roller 100, as shown in FIGS. 1 to 3, is disposed inside a frame 110. The frame 110 can protect and support the roller 100 therein. The frame 110, as shown in FIG. 1, may be composed of a vertical frame 112 and a horizontal frame 111, and the vertical frame 112 and the horizontal frame 111 can be separably combined and can keep the roller 100 therein. The frame 110 may have a fixing structure such as a bracket on a side to be easily mounted on a wall, for example, by a window. The vertical frame 112 may be installed in contact with both ends of the roller 100 and the horizontal frame 111 may be disposed between the ends. The structure or shape of the frame 110 may be changed in various ways.

The roller 100 is coupled to a shaft to rotate. Both ends of the roller 100 can be coupled to the frame through rotary structures having a shaft. The shaft structure that rotatably fixes the roller 100 may be changed in various ways. A shown in FIG. 2, the roller 100 can be rotated by couplers 400 having a fixing shaft 410 and coupled to both ends of the roller 100 and a connection shaft 320 fitted in the torsion spring 300. That is, various shaft structures that are coupled to both ends of the roller 100 and rotatably support the roller 100 can be used. The roller 100 may be a hollow cylindrical pipe and more compact coupling structure can be achieved using the internal space of the cylindrical pipe.

The screen 200 is wound or unwound on the roller 100, whereby the length is changed. The screen 200 has an upper end fixed to the outer side of the roller 100 and a lower end connected with the weight 210, so tension can be increased. When the roller 100 is rotated in a direction, the screen 200 is wound up around the roller 100, so the length of the unwound part is decreased. When the roller 100 is rotated in the opposite direction, the screen 200 is unwound down from the roller 100, so the length of the unwound part is increased. That is, the screen 200 can be moved up and down by rotation of the roller 100. The screen 200 may be made of fabric and may be made of other various materials that can block light.

The screen 200 extends in the direction of gravity from the outer side of the roller 100, as shown in FIG. 1. The screen 200 tangentially extends from the outer side of the roller 100 and exerts load at a position spaced by the radius of the roller 100 from the rotational center of the roller 100. Accordingly, torque (first-directional torque) is applied to the roller 100 by the weight of the screen 200. The roller 100 is rotated in the unwinding direction of the screen 200 (in a first direction) by the torque. When the rotational angle of the roller 100 increases, the unwound length of the screen 200 increases, and when the unwound length of the screen 200 increases, the weight also increases, so the torque applied to the roller 100 by the screen 200 also increases. That is, the rotational angle of the roller 100 and the increment (magnitude) of the torque applied to the roller 100 by the screen 200 are proportioned, so the increasing ratio A1 of the torque applied to the roller 100 by the screen to the rotational angle of the roller 100 can be set.

The torsion spring 300 is disposed in the roller 100, as shown in FIGS. 2 and 3. The torsion spring 300 contracts or stretches while rotating with the roller 100. The torsion spring 300 may be a torsional elastic body that keeps elastic energy by elastically deforming with rotation of the roller 100 and the torsional elastic body may be a coil spring. Both ends of the torsion spring 300, as shown in FIG. 3, may be connected to a rotary block 310 and the fixing portion 321 of the connection shaft 320, respectively. The rotary block 310 can rotate with the roller 100 with the fixing portion 321 fixed, so it can twist the torsion spring 300.

The torsion spring 300 has a common rotational center C (see FIG. 5) with the roller 100. Accordingly, the rotational angles θ (see FIG. 5) of the roller 100 and the torsion spring 300 (the rotational angle of the torsion spring is the same as the torsion angle) can be the same about the same center. The torsion spring 300 may be inserted on the rotational center of the roller 100 in parallel in the roller 100. One end of the torsion spring 300 may be connected to the roller 100 and the other end may be fixed to the shaft (connection shaft) passing through the rotational center of the roller 100.

The connection shaft 320 passes through the rotational center of the rotary block 310 and the rotary block 310 can simultaneously rotate with the roller 100 because holders 311 on the outer side of the rotary block 310 are fitted in guide rails 101 (see FIGS. 2 and 3) inside the roller 100. The connection shaft 320 can be fixed by fitting a coupling portion 321 (see FIG. 3) at an end to a coupling groove 112*a* of the vertical frame 112. The coupling groove 112*a* may be angled to prevent rotation of the connection shaft 320 and the connection shaft 320 may be firmly fixed to the vertical frame 112 by adding screws. The connection shaft 320 can rotatably support the roller 100 using a rotary ring 322 fitted on the fixing portion 321.

According to this structure, when the roller 100 is rotated, the rotary block 310 is also rotated and a first end, which is connected to the rotary block 310, of the torsion spring 300 can be twisted. The connection shaft 320 rotatably supports the roller 100, but does not rotate, so a second end, which is fixed to the connection shaft 320, of the torsion spring 300 is maintained fixed. Accordingly, torsion is generated between the first end and the second end of the torsion spring 300, whereby elastic energy is stored. The torsion spring 300 can be configured in this way. However, the configuration of the torsion spring 300 should not be construed as being limited thereto and the torsion spring 300 may be configured in other ways that can generate torque by applying elastic force to the roller 100.

The more the roller 100 is rotated, the larger the deformation of the torsion spring 300 is and the larger the restoring force is accordingly. The restoring force acts in the opposite direction to the rotation causing the deformation, so torque is generated in the opposite direction to the rotational direction of the torsion spring 300. That is, torque (second-directional torque) is applied to the roller 100 by the torsion spring 300 in the opposite direction to the torque that is applied by the screen 200. The roller 100 is rotated in the winding direction of the screen 200 (in a first direction) by the torque applied by the torsion spring 300. The magnitude of the torque generated by the torsion spring 300 is in proportion to the rotational angle and the rotational angle of the torsion spring 300 is the same as the rotational angle of the roller 100, so the increment (magnitude) of the torque generated by the torsion spring 300 is also in proportion to the rotational angle of the roller 100. Accordingly, it is possible to set the increasing ratio A2 of the torque applied to the roller 100 by the torsion spring 300 to the rotational angle of the roller 100.

That is, it is possible to set the increasing ratio A1 of the torque applied to the roller 100 by the screen to the rotational angle of the roller 100 and the increasing ration A2 of the torque applied to the roller 100 by the torsion spring 300 to the rotational angle of the roller 100, and the increasing ratios can be matched by the correlation equation satisfied by parameters of the roller 100, the screen 200, and the torsion spring 300. Accordingly, it is possible to offset (cancel out) the torques generated in the opposite directions and finely maintain balance by matching the increments of torque at rotational positions of the roller 100. Further, the difference between the magnitude of the torque applied to the roller 100 by the torsion spring 300 and the magnitude of the torque applied to the roller 100 by the screen 200 can be removed by the weight 210 connected to the lower end of the screen 200. Further, it is possible to remove the difference between the magnitude of the torque applied to the roller 100 by the weight 210 and the screen 200 and the magnitude of the torque applied to the roller 100 by the torsion spring 300 by adjusting tension of the torsion spring 300. As described above, it is possible to offset the torques generated in the opposite directions and finely maintain the balance by correcting not only the increasing ratios of the torques, but the differences of the magnitudes of the torques. This will be described in more detail below.

The coupler 400 may be fastened to the end, opposite to the other end which is coupled to the torsion spring 300, of the roller 100, as shown in FIG. 2. The coupler 400 may have a fixing shaft 410 and a rotary member 420 fitted on the fixing shaft 410 and the rotary member 420 can rotatably support the roller 100. An end of the fixing shaft 410 is coupled to the connection groove 112*a* of the vertical frame 112, whereby the fixing shaft 410 can be fixed. The connection groove 112*a* may be angled to prevent rotation of the fixing shaft 410 and, if necessary, the fixing shaft 410 can be firmly fixed by adding screws.

It is possible to manufacture a modified coupler 400*a*, as shown in FIG. 4. In particular, it is possible to make rotation smoother by installing a bearing 430 between the rotary member 420 and the fixing shaft 410. That is, it is possible to reduce friction due to rotation of the roller 100 and make rotation smoother, using a bearing 430 disposed between the roller 100 and the shaft (fixing shaft) coupled to the roller 100, so it is possible to more precisely adjust the position. A coupling hole 411 is formed at the fixing shaft 410, so the fixing shaft can be fixed to the frame by inserting a coupling member in the coupling hole 411. Friction necessarily exists in the entire cordless blind apparatus, but it is possible to prevent unnecessary excessive friction using the bearing 430. In particular, according to the present invention, since the pair of torques T1 and T2 (see FIG. 1) that is applied in the opposite directions to the roller 100 is offset through fine adjustment, even if friction is reduced by the bearing 430, the blind apparatus can be smoothly operated.

Hereafter, the correlation equation, the torques applied to the roller, the increasing ratios of torques that are matched through the correlation equation, the initial values of the torques, and an adjustment process are described in more detail with reference to FIGS. 5 to 7.

FIG. 5 is a view showing the operation principle of the cordless blind apparatus shown in FIG. 1, FIG. 6 is an exploded view showing the roller, the screen, the torsion spring, and the weight of the cordless blind apparatus shown in FIG. 1, and FIGS. 7A and 7B are views showing graphs that show a method of adjusting the cordless blind apparatus.

In FIG. 5, the roller 100 and the screen 200 are cut and shown with the torsion spring 300. The torsion spring 300 shares the rotational center C with the roller 100 and is coupled to the roller 100 through the rotary block 310. The rotational angle θ of the roller 100 and the rotational angle θ of the torsion spring 300 that are measured about the rotational center C are the same. Further, as described above, since the increment (magnitude) of the torque applied to the roller 100 by the screen 200 is in proportion to the rotational angle of the roller 100 and the increment (magnitude) of the torque applied to the roller 100 by the torsion spring 300 is also in proportion to the rotational angle of the roller 100, it is possible to determine the increasing ratios A1 and A2 of the torques by inducing the increments of the torques as a function of the rotational angle and then differentiating the function with respect to the rotational angle.

First, the increasing ratio A1 of the torque applied to the roller 100 by the screen 200 to the rotational angle of the roller 100 is determined from the following equation.

$$A1=\rho\times t\times S\times R^2\times g \qquad \text{[Equation 1]}$$

[Characters]

ρ: density of screen, t: thickness of screen, S: width of screen, R: radius of roller, g: gravitational acceleration As shown in FIG. 5, as the rotational angle θ is increased, the length (l) of the screen 200 is increased and the weight is correspondingly increased. The weight is density of screen×volume of screen×gravitational acceleration and the volume of the screen is thickness of screen×width of screen×length of screen, but according to the circular measure, the length of the screen is radius×rotational angle of roller. Accordingly, the weight can be expressed by density of screen×thickness of screen×radius of roller×rotational angle×gravitational acceleration, that is, $\rho\times t\times S\times R\times\theta\times g$.

The weight expressed as above generates torque in the tangential direction from the outer side of the roller 100 at the position spaced by the radius of the roller 100 from the rotational center C of the roller 100, so torque that is the multiple of the weight and the radius of the roller is generated. That is, the increment of the torque applied by the screen 200 becomes $\rho\times t\times S\times R^2\times\theta\times g$. It is possible to obtain the increasing ratio A1 of the torque applied to the roller 100 by the screen member 200 to the rotational angle of the roller 100 by differentiating the increment with respect to the rotational angle θ (or dividing the increment by the rotational angle), as in Equation 1.

Meanwhile, the increasing ratio A2 of the torque applied to the roller 100 by the torsion spring 300 to the rotational angle of the roller 100 is determined by the following equation.

$$A2 = \frac{(d^4 \times E)}{(64 \times D \times N)}. \quad \text{[Equation 2]}$$

[Characters]

d: wire diameter of torsion spring, E: Young's modulus of torsion spring, D: diameter of torsion spring, N: winding number of torsion spring.

The proportional relationship between the magnitude of the torque generated by the torsion spring 300 and the rotational angle θ can be obtained from the relationship between the elastic energy accumulated in an elastic body and displacement, and particularly, for the torsion spring 300 having a circular cross-section, it can be rotational angle× (wire diameter of torsion spring)$^4$×Young's modulus of torsion spring×1/64×1/diameter of torsion spring×1/winding number of torsion spring. That is, the increment of the torque applied by the torsion spring 300 is $\theta \times (d^4 \times E)/(64 \times D \times N)$, and it is possible to obtain the increasing ratio A2 of the torque applied to the roller 100 by the screen member 200 to the rotational angle of the roller 100 by differentiating the increment with respect to the rotational angle θ (or dividing the increment by the rotational angle), as in Equation 2.

Therefore, it is possible to match the increasing ratio A1 of the torque applied to the roller 100 by the screen 200 to the rotational angle of the roller 100 and the increasing ratio A1 of the torque applied to the roller 100 by the torsion spring 300 to the rotational angle of the roller 100 to each other, as in the correlation equation, A1=A2. For example, it is possible to match the increasing ratios A1 and A2 of torque for different cordless blind apparatuses, if necessary, by adjusting parameters such as the diameter 2R of the roller 100, the diameter D of the torsion spring 300, the wire diameter d of the torsion spring 300, the winding number of the torsion spring 300, the density of the screen 200 (which can obtained by dividing the total mass of the screen 200 by the volume of the screen 200, that is, total length L of the screen 200×thickness t of the screen 200×width S of the screen 200), the thickness t of the screen 200, and the width S of the screen 200, as shown in FIG. 6.

The increasing ratios A1 and A2 of torques are ratios when the magnitudes of the torques T1 and T2 (see FIG. 1) applied in opposite directions to the roller 100 in accordance with the rotational angles of the roller 100 are increased, so, as shown in FIG. 7A and FIG. 7B, they are the same as the inclinations of the graphs of a change of torque T and a rotational angle θ. As shown in the figures, it is possible to obtain a torque curve that linearly increases with the same proportion by matching the increasing ratio A1 and the increasing ratio A2 to each other. That is, when the roller 100 (see FIGS. 5 and 6) is rotated, it is possible to adjust the increasing rate of the torque applied to the roller 100 by the screen 200 (see FIGS. 5 and 6) and the increasing rate of the torque applied to the roller 100 by the torsion spring 300 (see FIGS. 5 and 6) to be perfectly the same. In particular, even if the initial values of the torques are different, as shown in FIG. 7A, it is possible to match the increasing ratio A1 of torque and the increasing ratio A2 of torque by adjusting the parameters through the correlation equation.

The difference between the magnitudes of the torques can be very easily removed by the weight 210 (see FIG. 6) and the torsion spring 300. For example, when the tension is increased by the weight 210 connected to the lower end of the screen 200, the load of the weight 210 is added to the screen 200, so the initial value of the torque applied to the roller 100 by the screen 200 (the initial value of T1 in FIG. 7A and FIG. 7B) is increased as in FIG. 7A and FIG. 7B. Further, when the tension of the torsion spring 300 is adjusted by ways such as winding the torsion spring 300 with the roller 100 fixed, the initial value of the torque applied to the roller 100 by the torsion spring 300 (the initial value of T2 in FIG. 7A and FIG. 7B) is also increased as in FIG. 7A and FIG. 7B. Accordingly, it is possible to obtain a pair of torques that is linearly increased with the same increasing ratios (A1 and A2) with the initial values completely matched to each other. The torques T1 and T2 (see FIG. 1) has opposite directions, but completely same magnitude, so they can be offset (calceled out) at each rotational angle with the balance very finely maintained. Accordingly, it is possible to very precisely and accurately operate the screen 200.

In particular, the initial values of the torques may be the torque values when the screen 200 has been fully rolled up (the unwound length (l) of the screen may be 0 in FIG. 5, so the rotational angle θ may also be 0 in FIG. 5). That is, the initial value of the torque applied to the roller 100 by the torsion spring 300 when the screen 200 has been fully rolled up can be adjusted to be the same as the torque applied to the roller 100 by the weight 210 and the screen, so a pair of torques that are balanced and completely offset can be obtained.

FIGS. 8 and 9 are views showing the operation of the cordless blind apparatus shown in FIG. 1.

Accordingly, as shown in FIGS. 8 and 9, the cordless blind apparatus 1 can be very conveniently and accurately operated. It is possible to easily interrupt the balanced state and adjust the length of the screen 200 with a minimum external force (by simply touching the screen or the weight), but it is also possible to easily maintain the screen at the length by removing the external force to return to the balanced state. By using the pair of torques T1 and T2 that are increased or decreased in opposite directions depending on the unwound length of the screen 200, it can be precisely maintained balanced state.

First, the screen 200 can be unwound, as shown in FIG. 8. In this case, the roller 100 is rotated, as shown in (a) of FIG. 8, so the rotary block 310 combined with the roller 100 is also rotated. Accordingly, the torsion spring 300 connected to the rotary block 310 deforms and keeps elastic energy. The torsion spring 300 deforms to correspond to the unwound length of the screen 200, whereby the restoring force is increased. The restoring force acts as the second-directional torque T2 (that is, the torque applied to the roller 100 by the torsion spring 300), as shown in (b) of FIG. 8.

Further, the first-directional torque T1 (the torque applied to the roller 100 by the screen 200) is also increased. The load as much as the unwound length of the screen is added to the load of the weight 210, the gravitational action is enhanced. Accordingly, the tension in the screen 200 is increased by the gravity and the increased tension acts as the first-directional torque T1. The first-directional torque T1 is formed in the exact opposite direction to the second-directional torque T2, so balance can be maintained. In particular, according to the cordless blind apparatus 1 of the present invention, the increasing ratios A1 and A2 of torques are matched through the correlation equation, as described above, and the initial values of the torques are also matched, so the magnitudes of the first-directional torque T1 and the second-directional torque T2 finely increase and balance.

This action is performed in the same principle even though the screen 200 is wound, as shown in FIG. 9. As shown in (b) of FIG. 9, when the screen 200 is wound, the roller 100 is rotated in the opposite direction, as shown in (a)

of FIG. 9, the deformation of the torsion spring 300 reduces and the original shape is restored, and the kept elastic energy is reduced and the restoring force is also decreased. Accordingly, the second-directional torque T2 correspondingly reduces. Further, the unwound length of the screen 200 reduces, the gravitational action is made only by the load of the weight 210, so the first-directional torque T1 applied to the roller 100 is also correspondingly decreased. Accordingly, the first-directional torque T1 and the second-directional torque T2 also balance with each other and the roller 100 is maintained stopped.

In particular, in the state shown in FIG. 9, the screen 200 has been fully rolled up and the initial value of the torque applied to the roller 100 by the torsion spring 300 (that is, the second-directional torque T2) is the same as the initial value of the torque applied to the roller 100 by the weight 210 and the screen 200 (that is, the first-directional torque T1 (see FIG. 7A and FIG. 7B).

That is, regardless of winding or unwinding of the screen 200, the pair of opposite torques applied to the roller 100 is increased or decreased with the balance finely maintained, so the position of the roller 100 can be maintained. In particular, since the increasing ratios A1 and A2 of the torques are matched through the correlation equation and the initial values of the torques are also matched so that the magnitudes of the first-directional torque T1 and the second-directional torque T2 are finely increased with the balance maintained, the screen 200 can be finely operated by a smaller external force. Accordingly, it is possible to obtain a remarkably improved and very convenient use environment using the cordless blind apparatus 1 of the present invention.

A method of adjusting the cordless blind apparatus according to an embodiment of the present invention is described hereafter in detail with reference to FIG. 10. For simple and clear description, description of the components described above is substituted with the above description, unless specifically stated. Further, the following description refers to the flowchart shown in FIG. 10, but also refers to the figures described above for the components to be described.

FIG. 10 is a flowchart illustrating the method of adjusting a cordless blind apparatus according to an embodiment of the present invention.

Referring to FIG. 10, a method of adjusting a cordless blind apparatus according to an embodiment of the present invention is a method of adjusting a cordless blind apparatus 1 that includes a roller 100 coupled to a shaft to rotate, a screen 200 wound or unwound on the roller 100, a torsion spring 300 contracting or stretching by rotating with the roller 100, and a weight 210 connected to the lower end of the screen 200.

The method includes a first step (S100) of matching the increasing ratio of torque applied to the roller 100 by the screen 200 to the rotational angle of the roller 100 and the increasing ratio of torque applied to the roller 100 by the torsion spring 300 to the rotational angle of the roller 100 to each other.

The method includes a second step (S200) of removing the difference between the magnitude of the torque applied to the roller 100 by the weight 210 and the screen 200 and the magnitude of the torque applied to the roller 100 by the torsion spring 300 by adjusting tension of the torsion spring 300.

The first step corresponds to the step of adjusting the increasing ratios A1 and A2 of torques described with reference to FIGS. 5 to 7. In particular, the first step corresponds to a process of matching the increasing ratio A1 of the torque applied to the roller 100 by the screen 200 to the rotational angle of the roller 100 and the increasing ratio A1 of the torque applied to the roller 100 by the torsion spring 300 to the rotational angle of the roller 100 to each other. As described above, it is possible to easily match the increasing ratios A1 and A2 of torques to each other for the following correlation equation, using the wire diameter 'd' of the torsion spring 300, the Young's modulus 'E' of the torsion spring 300, the diameter 'D' of the torsion spring 300, the winding number 'N' of the torsion spring 300, the density 'ρ' of the screen 200, the thickness 't' of the screen 200, the width 'S' of the screen 200, the radius 'R' of the roller 100, and gravitational acceleration 'g'.

$$A1 = A2,\ A1 = \rho \times t \times S \times R^2 \times g, \qquad \text{[Correlation equation]}$$

$$A2 = \frac{(d^4 \times E)}{(64 \times D \times N)}$$

This may be a process of matching the inclinations of torque curves in the graph of FIG. 7A and FIG. 7B. In detail, it is possible to completely match the increasing ratios A1 and A2 of torque by performing the first step to adjust parameters such as the diameter 2R of the roller 100, the diameter D of the torsion spring 300, the wire diameter d of the torsion spring 300, the winding number of the torsion spring 300, the density of the screen 200 (which can obtained by dividing the total mass of the screen 200 by the volume of the screen 200, that is, total length L of the screen 200×thickness t of the screen 200×width S of the screen 200), the thickness t of the screen 200, and the width S of the screen 200, as shown in FIG. 6.

The second step is a step of adjusting the initial values of the torques described with reference to FIG. 7A and FIG. 7B. In particular, the second step can be performed to match the initial value of the torque applied to the roller 100 by the torsion spring 300 and the initial value of the torque applied to the roller 100 by the weight 210 and the screen 200 when the screen 200 has been fully rolled up. In this process, it is possible to adjust tension by winding or unwinding the torsion spring 300 with the roller 100 stopped when the screen 200 has been fully rolled up. Further, in order to more actively use the weight 210 to adjust the initial values of the torques, it may be considered to adjust load by inserting a balance weight in the weight 210 or change load by winding the screen 200 inside the weight 210.

By performing the first step and the second step, as described above, it is possible to offset the pair of torques applied in opposite directions to the roller 100 with the balance finely maintained. After the second step, it is possible to check and examine the operation through a test run of the cordless blind apparatus 1 (S300), and when it is determined that there should be additional correction or readjustment (S400), the second step may be performed again. That is, since it is possible to easily change the initial values of the torque by winding or unwinding the torsion spring 300 through the second step, it is possible to balance the torques by repeatedly and more precisely adjusting the torsion spring, if necessary. It is possible to more precisely operate the screen 200 by adjusting the cordless blind apparatus 1 in this way. Accordingly, it is possible to obtain a remarkably improved and very convenient use environment through the method of adjusting a cordless blind apparatus of the present invention.

Although exemplary embodiments of the present invention were described above with reference to the accompanying drawings, those skilled in the art would understand that the present invention may be implemented in various ways without changing the necessary features or the spirit of the prevent invention. Therefore, it should be understood that the exemplary embodiments are not limiting but illustrative in all aspects.

INDUSTRIAL APPLICABILITY

The present invention relates to a cordless blind apparatus that allows for easily operating a screen and stably maintaining the length of the screen even without a cord, and is very useful for a blind apparatus and various related industrial fields. In particular, according to the present invention, it is possible to precisely adjust and maintain balance of a cordless blind apparatus including a screen, so it is possible to more conveniently and accurately adjust a cordless blind apparatus. Further, according to the preset invention, it is possible to very precisely adjust balance of a cordless blind apparatus even if parameters such as the material of the screen and the diameter of the roll are changed, so it is possible to achieve a cordless blind apparatus that is very precisely and accurately operated. Accordingly, the present invention has very high industrial applicability.

[Reference Signs List]

| | |
|---|---|
| 1: Cordless blind apparatus | 100: Roller |
| 101: Guide rail | 110: Frame |
| 111: Horizontal frame | 112: Vertical frame |
| 112a: Connection groove | 200: Screen |
| 210: Weight | 300: Torsion spring |
| 310: Rotary block | 311: Holder |
| 320: Connection shaft | 321: Fixing portion |
| 322: Rotary ring | 323: Coupling portion |
| 400, 400a: Coupler | 410: Fixing shaft |
| 411: Coupling hole | 420: Rotary member |
| 430: Bearing | θ: Rotational angle |
| *112T, T1, T2: Torque | d: Wire diameter of torsion spring |
| E: Young's modulus of torsion spring | |
| D: Diameter of torsion spring | |
| N: Winding number of torsion spring | |
| ρ: Density of screen | |
| t: Thickness of screen | S: Width of screen |
| l: Length of screen | L: Total length of screen |
| R: Radius of roller | g: Gravitational acceleration |

The invention claimed is:

1. A cordless blind apparatus comprising:

a roller coupled to a shaft to rotate;

a screen configured to be wound or unwound on the roller; and a torsion spring configured for contracting or stretching by a rotation of the roller, wherein an increasing ratio (A1) of a torque applied to the roller by the screen to a rotational angle of the roller and an increasing ratio (A2) of a torque applied to the roller by the torsion spring to the rotational angle of the roller are matched to each other through a following correlation equation;

$$A1 = A2,\ A1 = \rho \times t \times S \times R^2 \times g,$$

$$A2 = \frac{(d^4 \times E)}{(64 \times D \times N)}$$

wherein d is a wire diameter of the torsion spring, E is the Young's modulus of the torsion spring, D is a diameter of the torsion spring, N is a winding number of the torsion spring, ρ is a density of the screen, t is a thickness of the screen, S is a width of the screen, R is a radius of the roller, and g is the gravitational acceleration.

2. The cordless blind apparatus of claim 1, further comprising a weight connected to a lower end of the screen for removing a difference between a magnitude of the torque applied to the roller by the torsion spring and a magnitude of the torque applied to the roller by the screen.

3. The cordless blind apparatus of claim 2, wherein, when the screen has been fully rolled up, an initial value of the torque applied to the roller by the torsion spring is equal to an initial value of a torque applied to the roller by a combination of the weight and the screen.

4. The cordless blind apparatus of claim 1, wherein the torsion spring shares a rotational center with the roller.

5. The cordless blind apparatus of claim 4, wherein the torsion spring is disposed around the rotational center of the roller in parallel with the roller.

6. The cordless blind apparatus of claim 5, wherein an end of the torsion spring is connected to the roller and another end is fixed to the shaft passing through the rotational center of the roller.

7. The cordless blind apparatus of claim 1, further comprising a bearing disposed between the roller and the shaft coupled to the roller.

8. A method of adjusting a cordless blind apparatus that includes a roller coupled to a shaft to rotate, a screen configured to be wound or unwound on the roller, a torsion spring configured for contracting or stretching by a rotation of the roller, and a weight connected to a lower end of the screen, the method comprising:

matching an increasing ratio (A1) of a torque applied to the roller by the screen to a rotational angle of the roller and an increasing ratio (A2) of a torque applied to the roller by the torsion spring to the rotational angle of the roller to each other; and removing a difference between a magnitude of a torque applied to the roller by a combination of the weight and the screen and a magnitude of the torque applied to the roller by the torsion spring, by adjusting a tension of the torsion spring, wherein the matching of the increasing ratio (A1) with the increasing ratio (A2) is performed through a following correlation equation:

$$A1 = A2,\ A1 = \rho \times t \times S \times R^2 \times g,$$

$$A2 = \frac{(d^4 \times E)}{(64 \times D \times N)}$$

wherein d is a wire diameter of the torsion spring, E is the Young's modulus of the torsion spring, D is a diameter of the torsion spring, N is a winding number of the torsion spring, ρ is a density of the screen, t is a thickness of the screen, S is a width of the screen, R is a radius of the roller, and g is the gravitational acceleration.

9. The method of claim 8, further comprising matching an initial value of the torque applied to the roller by the torsion spring to an initial value of the torque applied to the roller by the combination of the weight and the screen, when the screen has been fully rolled up.

* * * * *